US006353391B1

(12) United States Patent
Shearer

(10) Patent No.: US 6,353,391 B1
(45) Date of Patent: Mar. 5, 2002

(54) BABY BOTTLE LOCATING SYSTEM

(76) Inventor: Kenneth N. Shearer, 2569 Brookside Dr., Medford, OR (US) 97504

( * ) Notice: Subject to any disclaimer, the term of this patent is extended or adjusted under 35 U.S.C. 154(b) by 0 days.

(21) Appl. No.: 09/663,127

(22) Filed: Sep. 15, 2000

(51) Int. Cl.[7] ..... G08B 23/00

(52) U.S. Cl. ..... 340/573.1; 340/573; 340/539; 340/825.36; 340/825.72; 340/571; 340/572

(58) Field of Search ..... 340/573.1, 573, 340/539, 825.36, 825.72, 571, 572

(56) References Cited

U.S. PATENT DOCUMENTS 3,714,578 A * 1/1973 Valdes ..... 325/319
4,101,873 A 7/1978 Anderson et al.
4,898,060 A 2/1990 To
5,000,581 A * 3/1991 Yata et al. ..... 374/150
5,344,034 A 9/1994 Eagan
5,349,329 A * 9/1994 Smith ..... 340/539
5,455,560 A * 10/1995 Owen ..... 340/539
5,629,677 A 5/1997 Staino, Jr.
5,638,050 A * 6/1997 Sacca et al. ..... 340/571
5,662,406 A * 9/1997 Mattice et al. ..... 362/101
D392,201 S 3/1998 Chen
5,859,585 A * 1/1999 Fleming ..... 340/539
5,929,781 A * 7/1999 Vosika ..... 340/825.72
5,945,918 A * 8/1999 McGoingal et al. ... 340/825.36

* cited by examiner

*Primary Examiner*—Daniel J. Wu
*Assistant Examiner*—Tai T. Nguyen

(57) ABSTRACT

A baby bottle locating system for locating misplaced baby bottles and soothing infants. The baby bottle locating system includes a remote transmitter for sending an activation signal, a bottle, a nipple positionable adjacent to an open end of the bottle, an annular cap member to secure the nipple to the bottle, a receiver for receiving the activation signal positioned within the annular cap member, and a sound producing assembly positioned within the annular cap member.

13 Claims, 3 Drawing Sheets

BABY BOTTLE LOCATING SYSTEM

BACKGROUND OF THE INVENTION

1. Field of the Invention

The present invention relates to locating devices and more particularly pertains to a new baby bottle locating system for locating misplaced baby bottles and soothing infants.

2. Description of the Prior Art

The use of locating devices is known in the prior art. More specifically, locating devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,101,873; 5,629,677; U.S. Pat. No. Des. 329,201; U.S. Pat. Nos. 4,898,060; and 5,344,034.

While these devices fulfill their respective, particular objectives and requirements, the aforementioned patents do not disclose a new baby bottle locating system. The inventive device includes a remote transmitter for sending an activation signal, a bottle, a nipple positionable adjacent to an open end of the bottle, an annular cap member to secure the nipple to the bottle, a receiver for receiving the activation signal positioned within the annular cap member, and a sound producing assembly positioned within the annular cap member.

In these respects, the baby bottle locating system according to the present invention substantially departs from the conventional concepts and designs of the prior art, and in so doing provides an apparatus primarily developed for the purpose of locating misplaced baby bottles and soothing infants.

SUMMARY OF THE INVENTION

In view of the foregoing disadvantages inherent in the known types of locating devices now present in the prior art, the present invention provides a new baby bottle locating system construction wherein the same can be utilized for locating misplaced baby bottles and soothing infants.

The general purpose of the present invention, which will be described subsequently in greater detail, is to provide a new baby bottle locating system apparatus and method which has many of the advantages of the locating devices mentioned heretofore and many novel features that result in a new baby bottle locating system which is not anticipated, rendered obvious, suggested, or even implied by any of the prior art locating devices, either alone or in any combination thereof.

To attain this, the present invention generally comprises a remote transmitter for sending an activation signal, a bottle, a nipple positionable adjacent to an open end of the bottle, an annular cap member to secure the nipple to the bottle, a receiver for receiving the activation signal positioned within the annular cap member, and a sound producing assembly positioned within the annular cap member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baby bottle locating system apparatus and method which has many of the advantages of the locating devices mentioned heretofore and many novel features that result in a new baby bottle locating system which is not anticipated, rendered obvious, suggested, or even implied by any of the prior art locating devices, either alone or in any combination thereof.

It is another object of the present invention to provide a new baby bottle locating system which may be easily and efficiently manufactured and marketed.

It is a further object of the present invention to provide a new baby bottle locating system which is of a durable and reliable construction.

An even further object of the present invention is to provide a new baby bottle locating system which is susceptible of a low cost of manufacture with regard to both materials and labor, and which accordingly is then susceptible of low prices of sale to the consuming public, thereby making such baby bottle locating system economically available to the buying public.

Still yet another object of the present invention is to provide a new baby bottle locating system which provides in the apparatuses and methods of the prior art some of the advantages thereof, while simultaneously overcoming some of the disadvantages normally associated therewith.

Still another object of the present invention is to provide a new baby bottle locating system for locating misplaced baby bottles and soothing infants.

Yet another object of the present invention is to provide a new baby bottle locating system which includes a remote transmitter for sending an activation signal, a bottle, a nipple positionable adjacent to an open end of the bottle, an annular cap member to secure the nipple to the bottle, a receiver for receiving the activation signal positioned within the annular cap member, and a sound producing assembly positioned within the annular cap member.

Still yet another object of the present invention is to provide a new baby bottle locating system that plays soothing melodies to calm babies.

Even still another object of the present invention is to provide a new baby bottle locating system that can be moved from bottle to bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
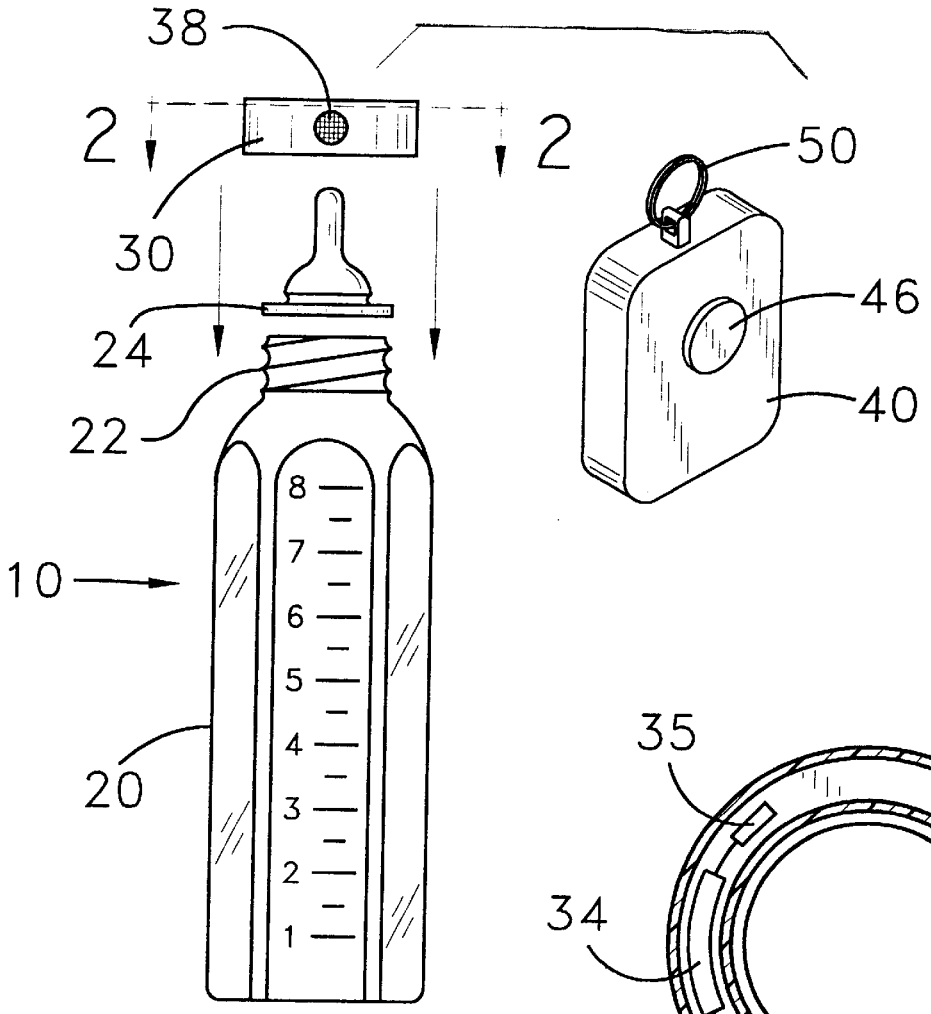
FIG. 1 is a schematic perspective view of a new baby bottle locating system according to the present invention.
Figure 2:
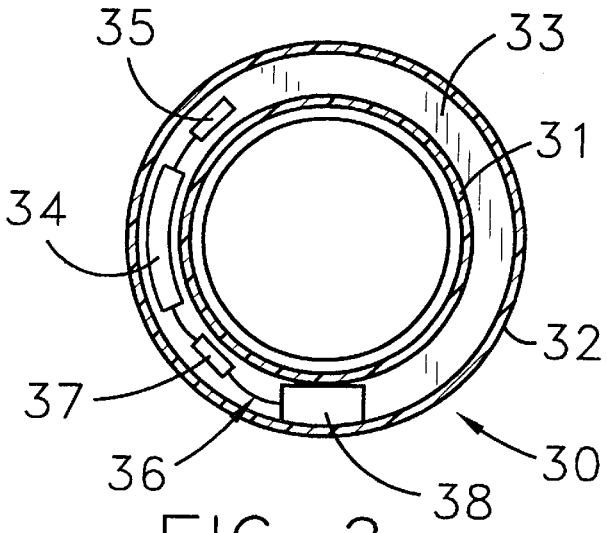
FIG. 2 is a schematic cross-sectional view of the annular cap member of the present invention taken along line 2—2 of FIG. 1
Figure 3:
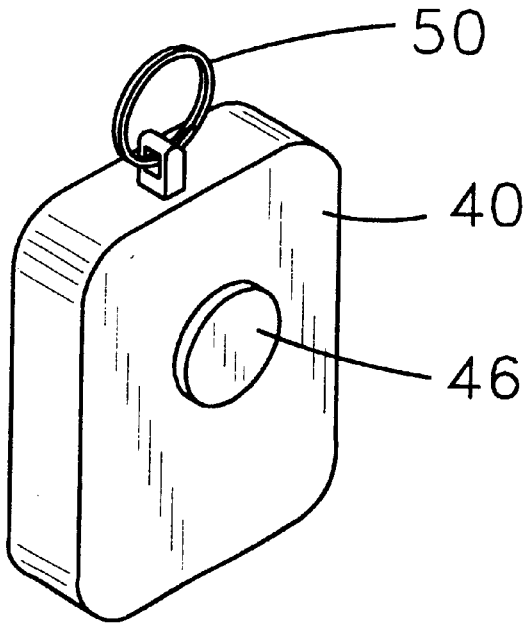
FIG. 3 is a schematic perspective view of the remote housing present invention.
Figure 4:
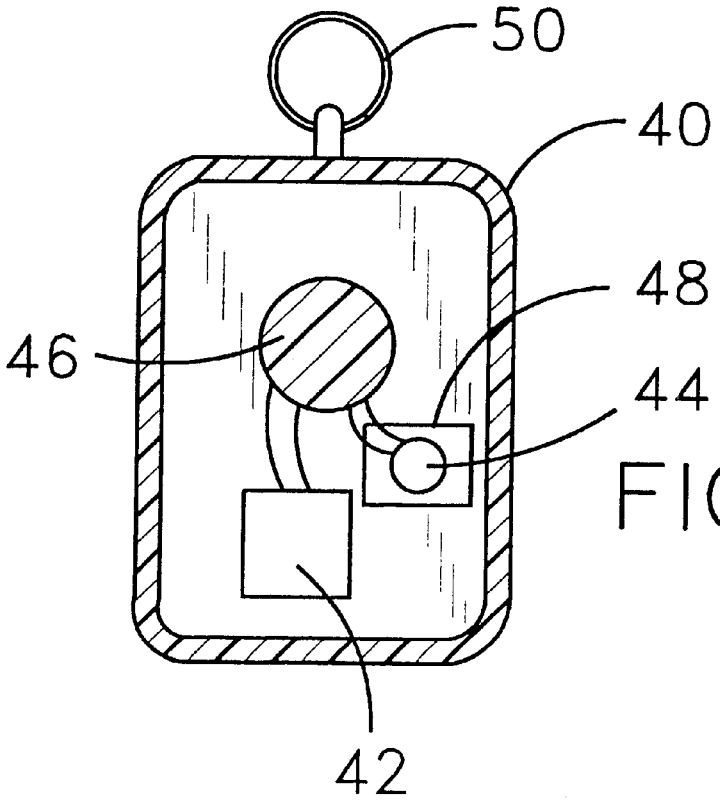
FIG. 4 is a schematic cross-sectional view of the remote housing of the present invention.
Figure 5:
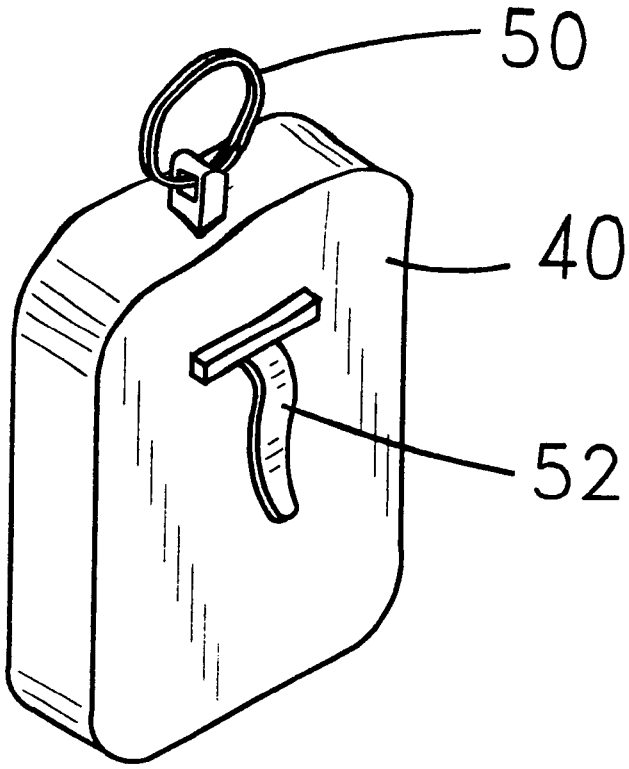
FIG. 5 is a schematic rear view of the remote housing of the present invention.

With reference now to the drawings, and in particular to FIGS. 1 through 5 thereof, a new baby bottle locating system embodying the principles and concepts of the present invention and generally designated by the reference numeral 10 will be described.

As best illustrated in FIGS. 1 through 5, the baby bottle locating system 10 generally comprises a remote housing 40, a remote transmitter 42, a bottle 20, a nipple 24, an annular cap member 30, a receiver 34, and a sound producing assembly 36.

The remote transmitter 42 is used for sending an activation signal. The remote transmitter 42 is positioned in the remote housing 40.

A remote battery 44 is positioned in the remote housing 40. The remote battery 44 is electrically connected to the remote transmitter 42.

The remote housing 40 includes a battery access door 48 positioned adjacent to the battery 44 for facilitating replacement of the battery 44.

A remote button 46 is coupled to the remote housing 40. The remote button 46 is operationally coupled to the remote transmitter 4. Thus the remote transmitter 42 transmits the activation signal upon depression of the remote button 46.

A key ring 50 is coupled to the remote housing 40. Thus the remote housing 40 is designed for coupling to a plurality of keys.

A resilient clip member 52 is coupled to an exterior of the remote housing 40. Thus the remote housing 40 is designed for coupling to an object using the clip member 52.

The bottle 20 includes an open top, a closed bottom, and a perimeter wall extending between the open top and the closed bottom. The nipple 24 includes an open bottom positionable adjacent to the open top of the bottle 20. The open top of the bottle 20 includes an exteriorly threaded portion 22.

The annular cap member 30 includes an inwardly threaded portion for engaging the exteriorly threaded portion 22 of the open top of the bottle 20 for coupling the annular cap 30 to the bottle 20.

The annular cap member 30 includes an annular inwardly extending lip for positioning against a rim of the open bottom of the nipple 24 such that the rim of the open bottom of the nipple 24 is secured between the lip of the annular cap member 30 and the open top of the bottle 20. Thus the cap member 30 secures the nipple 24 to the bottle 20 over the opening such that the nipple 24 is designed for distributing a liquid contained in the bottle 20 through the nipple 24.

The annular cap member 30 includes an annular interior wall 31, an annular exterior wall 32, a top, and a bottom 33 defining an interior space in the annular cap member 30. The receiver 34 is positioned in the interior space of the cap member 30 for receiving the activation signal from the remote transmitter 42.

The sound producing assembly 36 is positioned in the interior of the cap member 30. The sound producing assembly 36 is operationally coupled to the receiver 34 such that the sound producing assembly 36 produces a sound upon the receiver 34 receiving the activation signal from the remote transmitter 42.

The sound producing assembly 36 includes an electronic sound chip 37 and a speaker 38. The electronic sound chip 37 is operationally coupled to the receiver 34 for producing electronic sound signals upon the receiver 34 receiving the signal from the remote transmitter 42. The speaker 38 is operationally coupled to the electronic sound chip 37 for converting the electronic sound signals from the electronic sound chip 37 into sound.

A cap battery 35 is positioned in the interior space of the annular cap member 30. The cap battery 35 is electronically coupled to the receiver 34.

In use, the user activates the remote transmitter by depressing the button on the remote housing. The receiver receives the activation signal and provides the stimulus for the sound chip to begin generating its electronic sound signals which are converted by the speaker to sound. The user can then locate the baby bottle. The sound producing assembly can also be activated by the user in order to play music generated by the sound producing assembly to sooth the baby.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baby bottle locating system comprising:

a remote transmitter for sending an activation signal;

a bottle having an open top;

a nipple positionable adjacent to said open top of said bottle;

an annular cap member couplable to said bottle such that said cap member secures said nipple to said bottle over said open top;

a receiver positioned in an interior of said cap member for receiving said activation signal from said remote transmitter whereby said receiver is coupled to said bottle when said cap member secures said nipple to said bottle;

a sound producing assembly positioned in said interior of said cap member, said sound producing assembly being operationally coupled to said receiver such that said sound producing assembly produces a sound upon said receiver receiving said activation signal from said remote transmitter.

2. The baby bottle locating system of claim 1, further comprising:

a remote housing;

said remote transmitter being positioned in said remote housing;

a remote battery positioned in said remote housing, said remote battery being electrically connected to said remote transmitter.

3. The baby bottle locating system of claim 2, further comprising:

said remote housing including a battery access door positioned adjacent to said battery for facilitating replacement of said battery.

4. The baby bottle locating system of claim 2, further comprising:

a remote button coupled to said remote housing, said remote button being operationally coupled to said remote transmitter whereby said remote transmitter transmits said activation signal upon depression of said remote button.

5. The baby bottle locating system of claim 2, further comprising:

a key ring coupled to said remote housing whereby said remote housing is adapted for coupling to a plurality of keys.

6. The baby bottle locating system of claim 2, further comprising:

a resilient clip member coupled to an exterior of said remote housing whereby said remote housing is adapted for coupling to an object using said clip member.

7. The baby bottle locating system of claim 1, further comprising:

a bottle having an open top, a closed bottom, and a perimeter wall extending between said open top and said closed bottom;

a nipple having an open bottom positionable adjacent to said open top of said bottle;

said open top of said bottle having an exteriorly threaded portion;

an annular cap member, said annular cap member having an inwardly threaded portion for engaging said exteriorly threaded portion of said open top of said bottle for coupling said annular cap to said bottle;

said annular cap member having an annular inwardly extending lip for positioning against a rim of said open bottom of said nipple such that said rim of said open bottom of said nipple is secured between said lip of said annular cap member and said open top of said bottle whereby said cap member secures said nipple to said bottle over said opening such that said nipple is adapted for distributing a liquid contained in said bottle through said nipple.

8. The baby bottle locating system of claim 7, further comprising:

said annular cap member having an annular interior wall, an annular exterior wall, a top, and a bottom defining an interior space in said annular cap member.

9. The baby bottle locating system of claim 8, further comprising:

a receiver positioned in said interior space of said cap member for receiving said activation signal from said remote transmitter.

10. The baby bottle locating system of claim 9, further comprising:

a sound producing assembly positioned in said interior of said cap member, said sound producing assembly being operationally coupled to said receiver such that said sound producing assembly produces a sound upon said receiver receiving said activation signal from said remote transmitter.

11. The baby bottle locating system of claim 10, further comprising:

said sound producing assembly including an electronic sound chip and a speaker, said electronic sound chip being operationally coupled to said receiver for producing electronic sound signals upon said receiver receiving said signal from said remote transmitter, said speaker being operationally coupled to said electronic sound chip for converting said electronic sound signals from said electronic sound chip into sound.

12. The baby bottle locating system of claim 9, further comprising:

a cap battery positioned in said interior space of said annular cap member, said cap battery being electronically coupled to said receiver.

13. A baby bottle locating system comprising:

a remote housing;

a remote transmitter for sending an activation signal, said remote transmitter being positioned in said remote housing;

a remote battery positioned in said remote housing, said remote battery being electrically connected to said remote transmitter;

said remote housing including a battery access door positioned adjacent to said battery for facilitating replacement of said battery;

a remote button coupled to said remote housing, said remote button being operationally coupled to said remote transmitter whereby said remote transmitter transmits said activation signal upon depression of said remote button;

a key ring coupled to said remote housing whereby said remote housing is adapted for coupling to a plurality of keys;

a resilient clip member coupled to an exterior of said remote housing whereby said remote housing is adapted for coupling to an object using said clip member;

a bottle having an open top, a closed bottom, and a perimeter wall extending between said open top and said closed bottom;

a nipple having an open bottom positionable adjacent to said open top of said bottle;

said open top of said bottle having an exteriorly threaded portion;

an annular cap member, said annular cap member having an inwardly threaded portion for engaging said exteriorly threaded portion of said open top of said bottle for coupling said annular cap to said bottle;

said annular cap member having an annular inwardly extending lip for positioning against a rim of said open bottom of said nipple such that said rim of said open bottom of said nipple is secured between said lip of said annular cap member and said open top of said bottle whereby said cap member secures said nipple to said bottle over said opening such that said nipple is adapted for distributing a liquid contained in said bottle through said nipple;

said annular cap member having an annular interior wall, an annular exterior wall, a top, and a bottom defining an interior space in said annular cap member;

a receiver positioned in said interior space of said cap member for receiving said activation signal from said remote transmitter whereby said receiver is coupled to said bottle when said cap member secures said nipple to said bottle;

a sound producing assembly positioned in said interior of said cap member, said sound producing assembly being operationally coupled to said receiver such that said sound producing assembly produces a sound upon said receiver receiving said activation signal from said remote transmitter;

said sound producing assembly including an electronic sound chip and a speaker, said electronic sound chip being operationally coupled to said receiver for producing electronic sound signals upon said receiver receiving said signal from said remote transmitter, said speaker being operationally coupled to said electronic sound chip for converting said electronic sound signals from said electronic sound chip into sound; and a cap battery positioned in said interior space of said annular cap member, said cap battery being electronically coupled to said receiver.

* * * * *